United States Patent [19]

Addie et al.

[11] Patent Number: 4,923,369

[45] **Date of Patent: * May 8, 1990**

[54] SLURRY PUMP HAVING INCREASED EFFICIENCY AND WEAR CHARACTERISTICS

[75] Inventors: Graeme R. Addie; Robert J. Visintainer, both of Augusta, Ga.

[73] Assignee: GIW Industries, Inc., Grovetown, Ga.

[ * ] Notice: The portion of the term of this patent subsequent to Oct. 3, 2006 has been disclaimed.

[21] Appl. No.: 367,306

[22] Filed: Jun. 13, 1989

Related U.S. Application Data

[63] Continuation of Ser. No. 22,787, Mar. 6, 1987, Pat. No. 4,872,809.

[51] Int. Cl.[5] ..... F04D 29/44

[52] U.S. Cl. ..... 415/206

[58] Field of Search ..... 415/203, 206, 207, 212.1, 415/227, 211.1

[56] References Cited

U.S. PATENT DOCUMENTS

| | | | |
|---|---|---|---|
| 353,994 | 12/1886 | Walker et al. | 415/206 |
| 1,291,037 | 1/1919 | Lole | 415/206 |
| 3,692,426 | 9/1972 | Ryall et al. | 415/206 |
| 3,759,628 | 9/1973 | Kempf | 415/206 |
| 3,930,746 | 1/1976 | Kronogard | 415/207 |
| 4,475,868 | 10/1984 | Renger | 416/206 |
| 4,872,809 | 10/1989 | Addie et al. | 415/206 |

*Primary Examiner*—Robert E. Garrett
*Assistant Examiner*—John T. Kwon
*Attorney, Agent, or Firm*—Hurt, Richardson, Garner, Todd & Cadenhead

[57] ABSTRACT

A high efficiency centrifugal slurry pump having satisfactory wear characteristics. The increased efficiency is obtained primarily through making the pump more narrow. Through careful control of the other pump dimensions, the increase in wear normally associated with higher efficiency narrow pumps can be reduced or eliminated.

3 Claims, 3 Drawing Sheets

SLURRY PUMP HAVING INCREASED EFFICIENCY AND WEAR CHARACTERISTICS

This is a continuation of co-pending application Ser. No. 07/022,787 filed on 03/06/87, now issued to U.S. Pat. No. 4,872,809.

BACKGROUND OF THE INVENTION

The present invention relates to centrifugal pumps, and more particularly to centrifugal pumps used for transporting slurries and other abrasive-containing fluids. Specifically the invention concerns centrifugal slurry pumps having physical dimensions such that they are capable of achieving a combination of high efficiency and low wear characteristics not heretofore possible.

A centrifugal pump consists basically of a rotatable impeller enclosed by a collector or shell. As the impeller is rotated, it generates velocity head at the periphery of the shell. The shell collects the velocity head and converts it to a pressure head. There are many configurations within the framework of this basic design. In one common configuration, the flow enters the shell on one side along the axis of rotation of the impeller, that is, the flow enters the shell at a point adjacent to the center of the impeller, referred to as the "eye" of the impeller, while the discharge of the shell is located at a point tangent to the shell outer periphery. The general performance of such a pump is shown in FIG. 1, wherein the flow BEPQ is that at the best efficiency point (BEP), the latter being the highest point of the parabolic efficiency curve. The best efficiency point head (BEPH) is defined as the head at BEP.

The magnitude of the head is largely determined by the impeller diameter, and the flow is mostly affected by the width of the pump and the size of the internal section area. The shell and the impeller tend to work like two nozzles in series, with the impeller generating, and the shell collecting, the head. A change to either will affect the head and the flow. Because both can be varied, more than one combination of variables of impeller and shell dimensions can achieve the same effect.

The magnitude of the peak efficiency is largely determined by the efficiency of the impeller and shell wetted geometry in generating and collecting the head and flow. The location of the BEP is affected in large part by the magnitude (width and depth) of the hydraulic sections. Larger hydraulic sections cause the location of the BEP to move to higher flows.

With regard specifically to slurry pumps, these pumps are subject to high wear due to the abrasive effect of particles in the slurry, which through impact and friction erode the various pump surfaces.

Heretofore, there has been no method of determining or predicting wear except by experience. Empirical data can be useful, except that the observation is global, that is, it does not indicate the individual effect of the different variables of slurry hardness, abrasive size and concentration, resistance of the pump materials of construction, the effect of the pump hydraulic sections and proportions, and the resulting effect on the fluid and slurry particle velocity. Without a means for determining the individual effects of the variables, slurry pump design has heretofore been preoccupied with minimizing wear.

As a consequence, slurry pump hydraulic sections have tended toward sizes larger than absolutely necessary in order to keep velocities down, since velocity is a large factor in the wear process. Decreased wear, however, comes at the expense of pump efficiency, since the pump is not operated at or near the BEP. This results in overall increased costs of operation.

Slurry pumps generally have wide impellers to allow passage of large spheres (slurry particles). The thicker metal sections dictated by manufacturing and/or wear considerations require slurry pump impellers to be wider than their equivalent water pump versions. The meridional section (radial section) velocities of a slurry pump impeller are also much lower than an equivalent centrifugal water pump. This means that the hydraulic sections and head losses in the shell play a more significant part in controlling the flow and location of the BEP compared to the more balanced water pumps. Without a tool to analyze and understand wear characteristics, however, it has previously not been possible to optimize the hydraulic energy efficiency and wear performance of slurry pumps.

One of the areas of high wear in slurry pumps is the tonque, which is subject to gouging wear. Tongue wear, or more particularly, wear in the sidewall sections of the tonque, is generally considered to be a three-dimensional phenomenon caused by the higher velocities in the throat and the different velocity in the area between the tongue and the impeller due to recirculating flow.

There is thus a need in the art for slurry pump designs which maximize efficiency without significantly increasing the wear characteristics.

DISCLOSURE OF THE INVENTION

It is accordingly an object of the invention to provide a slurry pump shell that when operated as an assembly with a shell and other parts provides having increased flow efficiency compared to prior art slurry pumps for a given rate of wear.

This object is achieved by a centrifugal pump shell within an assembly for pumping a slurry, the assembly which comprises (a) the shell defining a pump housing, the shell having a longtudinal axis and a radius and further including (1) a throat having an actual throat area, (2) a tongue positioned along a peripheral portion of the shell, and (3) an outlet branch; and (b) an impeller rotatably disposed within the housing for rotation about the axis, the impeller including (1) an outlet area, (2) a plurality of vanes, (3) inside and outside shrouds secured to said vanes and defining a shroud width, (4) an outside diameter, and (5) an eye having a diameter; wherein the ratio of the impeller outlet area to the shell actual throat area is from about 5.0 to about 9.0, wherein the ratio of the radius of the shell at the tongue to the radius of the shell at right angles to a centerline of the outlet branch is from about 0.6 to about 1.0, wherein the ratio of the impeller outside diameter to the shroud width is from about 5.0 to about 7.0, wherein the ratio of the impeller outside diameter to the impeller eye diameter is from about 1.5 to about 3.5, and wherein the ratio of the impeller outside diameter to the radius of the shell at the tongue is from about 1.5 to about 1.8.

Another object of the present invention is to provide an impeller that when operated with an assembly which includes a shell or casing, will provide increased flow efficiency compared to prior art slurry pumps for a given rate of wear.

DETAILED DESCRIPTION OF THE PREFERRED EMBODIMENTS

Pump designs meeting the objects of the invention have dimensions dictated by the application of novel analytical model as set forth in "Analytical Model and Experimental Studies on Slurry Flow and Erosion Flow and Erosion in Pump Casings," Roco, M.C. and Addie, G. R., Eighth International Technical Conference on Slurry Transporation, STA, San Francisco, CA (1983), and in "Erosion of Concentrated Slurries in Turbulent Flow," Roco, M.C., Nair, P., Addie, G. R. and Dennis, J., J. of Pipelines, 4 (1984) 213–221, Elsevier Science Publishers, Bv Amsterdam, The Netherlands.

Figure 2:
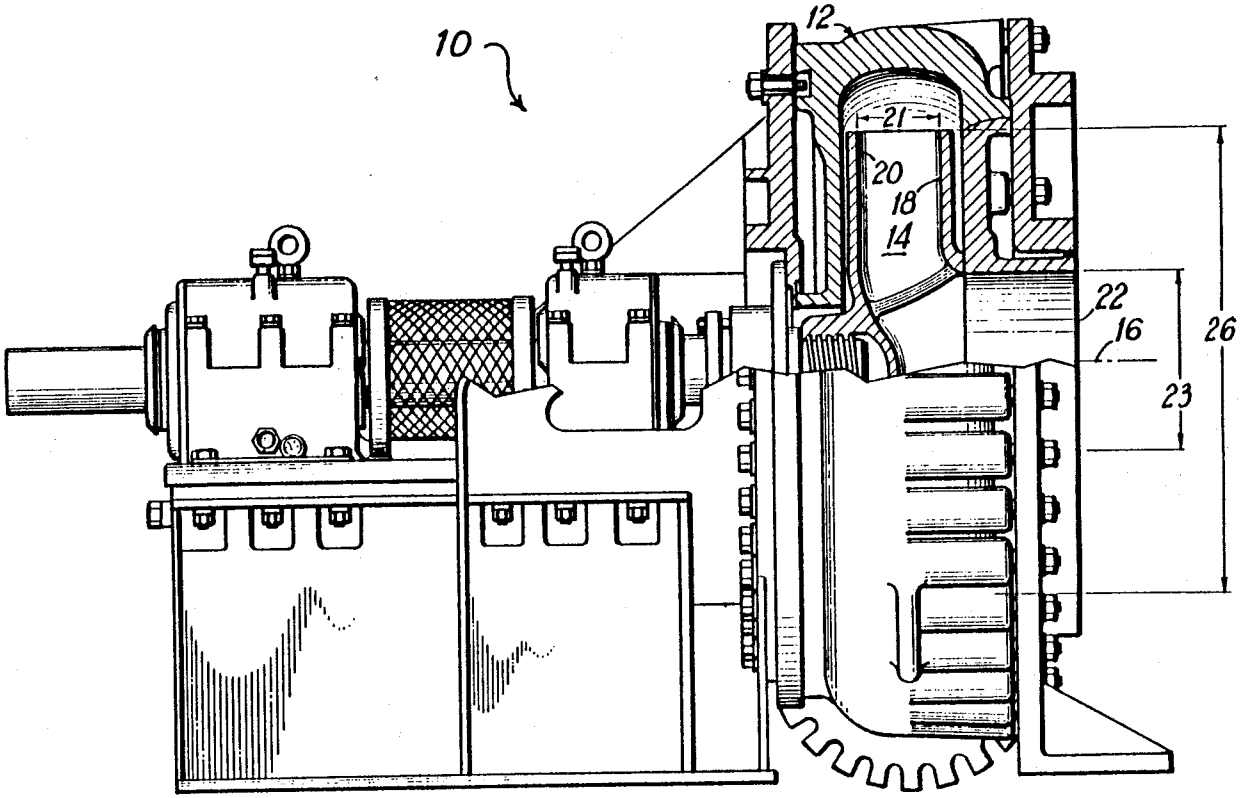
FIG. 2 is a partial cross-sectional view of a pump assembly showing the shell and the impeller of the present invention one.

FIG. 2 illustrates one embodiment of the slurry pump casing and impeller of the invention. The pump assembly, indicated generally by the number 10, comprises a shell 12 and an impeller 14 rotatably positioned along an axis 16 of the shell. The impeller 14 has front and back shrouds 18 and 20, respectively, which define a shroud width 21 and further has an impeller eye 22 having a diameter 23. The impeller also has an outside diameter 26. The impeller outlet area is defined as the impeller diameter by 3.142 by the distance between the shrouds, less the area of the vanes at the circumference of the impeller. The shell radius at right angle to the branch center line is defined as the radius from the center of the shell in plan view to a point on the outside of the volute section located adjacent the branch along a ine parallel to the branch face.

Figure 3:
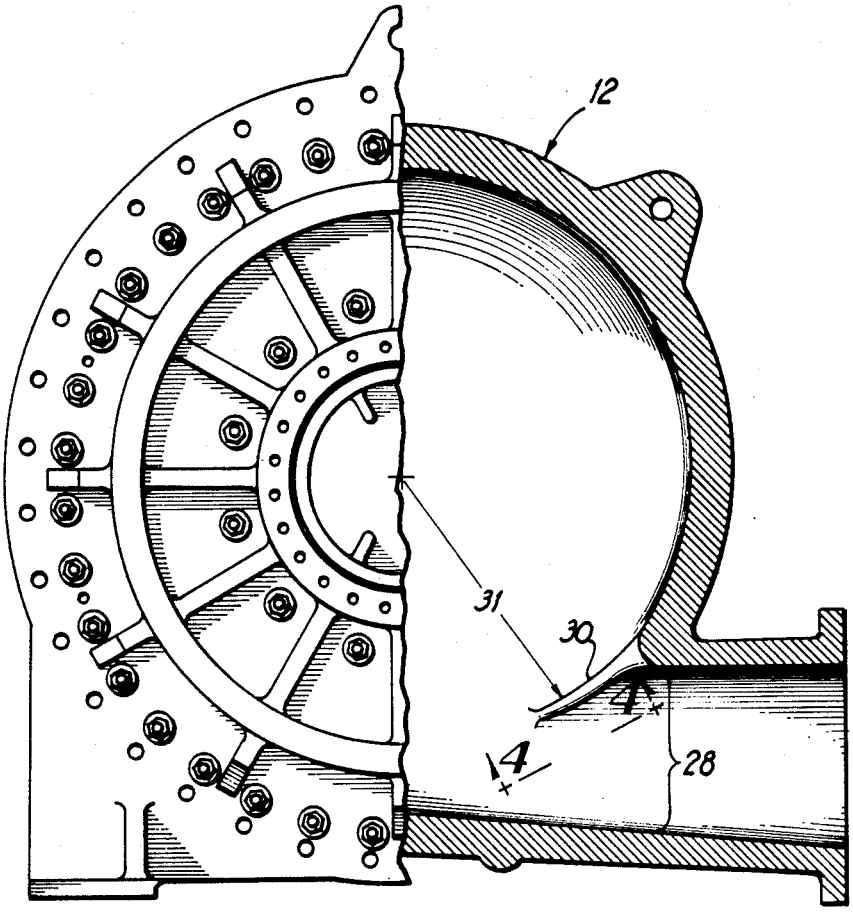
FIG. 3 is a cross-sectional view of the pump shell.

In FIG. 3 is shown a cross-sectional side view of the pump shell 12 including an actual throat 28 and a tongue 30. Also shown is the shell radius 31 at the tongue 30.

Figure 1:
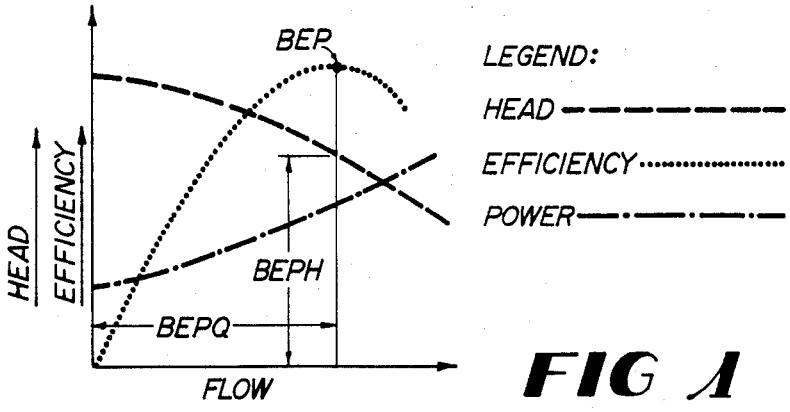
FIG. 1 is a graph of the efficiency of a centrifical pump at constant rotational speed as it varies with the flow rate through the pump.
Figure 4:
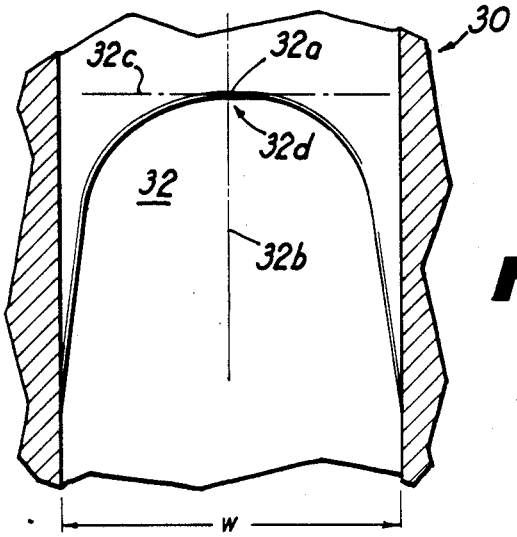
FIG. 4 is a sectional view taken along line 4—4 illustrating the cutwater shape of the pump shell.

FIG. 4, taken along 4–4 of FIG. 3, illustrates a cutwater 32 of the shell which defines the tongue 30. The cutwater has a special shape which reduces the effects of three-dimensional wear in the tongue.

Generally the shape is parabolic and is defined by the equation $y=Ax^B$, where x and y define the points on the parabola. The origin **32*a* of the x and y graph is the intersection of the shell parting line 32*b* (the centerline of the shell defining the "y" axis) and a line 32*c* perpendicular to the shell parting line (defining the "x" axis) which is tangent to the tongue tip 32*d***. Further, $A=F[2^B/w^{(B-1)}]$ where B is a number from 2 to 5, w is the width of the shell in inches, and F is a number from 1.0 to 0.5. In a preferred embodiment, B is 3, w is 11.5, F is 1.0 and, therefore, $A=0.06049$.

The following ratios define the critical dimensions of the pump of the invention. The ratio of the impeller outlet area to the shell actual throat area is from about 5.0 to about 9.0, preferrably from about 5.3 to about 5.75. The ratio of the radius of the shell at the tongue to the radius of the shell at a right angle to the branch centerline (as defined earlier) is from about 0.8 to about 0.9, preferably from about 0.85 to about 0.88. The ratio of the impeller outside diameter to the shroud width is from about 5.0 to about 7.0, preferably from about 5.5 to about 6.5. The ratio of the impeller outside diameter to the impeller eye diameter is from about 1.5 to about 3.5 and preferably from about 2.0 to about 3.0. The ratio of the impeller outside diameter to the radius of the shell at the tongue is from about 1.5 to about 1.8, and preferably from about 1.6 to about 1.75.

Figure 5:
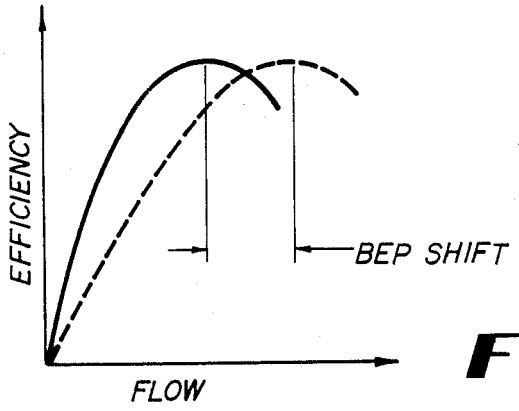
FIG. 5 is a graph illustrating the efficiency of a centrifugal pump of the invention as compared with that of the prior art.

Pumps assemblies using casings of the present invention and impellers of the present invention and constructed having the above dimensional ratios have increased hydraulic efficiency without significantly increased wear characteristics. Compared to prior art pumps, the pumps of the invention have been narrowed, which shifts the best efficiency point (BEP) to a lower flow rate, as shown qualitatively in FIG. 5, where the dashed line represents the prior art efficiency curve, and the solid line the efficiency curve of the pump of the invention. This lower BEP flow rate is closer to the duty flow rate, so that greater efficiency is obtained. The duty flow rate is the flow required to transport the slurry. At the same time, the wear characteristics of the pump have not been significantly degraded, as would be expected by narrowing the pump's thickness.

The following examples illustrate the invention. All dimensions are in inches.

EXAMPLE 1

A pump assembly was fabricated incorporating the shell of the present invention and the impeller of the present invention and having the following dimensional ratios:

$$\frac{\text{Impeller Outlet Area}}{\text{Shell Actual Throat Area}} \quad \frac{1108.1}{201.1} = 5.51$$

$$\frac{\text{Shell Radius at Tongue}}{\text{Shell Radius at Right Angle to Branch Centerline}} \quad \frac{27.125}{31.5} = 0.861$$

$$\frac{\text{Impeller-Outside Diameter}}{\text{Shroud Width}} \quad \frac{46}{8} = 6.75$$

$$\frac{\text{Impeller-Outside Diameter}}{\text{Impeller Eye Diameter}} \quad \frac{46}{18} = 2.56$$

$$\frac{\text{Impeller-Outside Diameter}}{\text{Shell Radius at Tongue}} \quad \frac{46}{27.125} = 1.7$$

Additional physical dimensions and performance characterics are given in TABLE 1.

EXAMPLE 2

A pump was considered having the following dimensional ratios:

$$\frac{\text{Impeller Outlet Area}}{\text{Shell Actual Throat Area}} \quad \frac{1011.7}{183.61} = 5.51$$

$$\frac{\text{Shell Radius at Tongue}}{\text{Shell Radius at Right Angle to Branch Centerline}} = \frac{27.12}{31.5} = 0.861$$

$$\frac{\text{Impeller-Outside Diameter}}{\text{Shroud Width 7}} = \frac{46}{7} = 6.57$$

$$\frac{\text{Impeller-Outside Diameter}}{\text{Impeller Eye Diameter}} = \frac{46}{18} = 2.56$$

-continued $$\frac{\text{Impeller-Outside Diameter}}{\text{Shell Radius at Tongue}} = \frac{46}{27.15} = 1.7$$

Additional physical dimensions and performance characteristics are given in TABLE 1.

COMPARATIVE EXAMPLE 1

A prior art pump having the following dimensional ratios was evaluated:

$$\frac{\text{Impeller Outlet Area}}{\text{Shell Actual Throat Area}} = \frac{1554.6}{233.705} = 6.65$$

$$\frac{\text{Shell Radius at Tongue}}{\text{Shell Radius at Right Angle to Branch Centerline}} = \frac{35.313}{35.375} = 1.00$$

$$\frac{\text{Impeller-Outside Diameter}}{\text{Shroud Width}} = \frac{44}{15.25} = 2.89$$

$$\frac{\text{Impeller-Outside Diameter}}{\text{Impeller Eye Diameter}} = \frac{44}{18} = 2.44$$

$$\frac{\text{Impeller-Outside Diameter}}{\text{Shell Radius at Tongue}} = \frac{40}{35.3} = 1.13$$

Additional physical dimensions and performance characteristics are given in TABLE 1.

COMPARATIVE EXAMPLE 2

A prior art pump assembly having the following dimensional ratios was evaluated:

$$\frac{\text{Impeller Outlet Area}}{\text{Shell Actual Throat Area}} = \frac{1008}{196.7} = 5.12$$

$$\frac{\text{Shell Radius at Tongue}}{\text{Shell Radius at Right Angle to Branch Centerline}} = \frac{25.875}{38.47} = 0.67$$

$$\frac{\text{Impeller-Outside Diameter}}{\text{Shroud Width}} = \frac{44}{11.25} = 3.91$$

$$\frac{\text{Impeller-Outside Diameter}}{\text{Impeller Eye Diameter}} = \frac{44}{18} = 2.44$$

$$\frac{\text{Impeller-Outside Diameter}}{\text{Shell Radius at Tongue}} = \frac{44}{25.875} = 1.7$$

Additional physical dimensions and performance characteristics are given in TABLE 1

COMPARATIVE EXAMPLE 3

A prior art pump assembly having the following dimensional ratios was evaluated:

$$\frac{\text{Impeller Outlet Area}}{\text{Shell Actual Throat Area}} = \frac{1365}{217} = 6.29$$

-continued $$\frac{\text{Shell Radius at Tongue}}{\text{Shell Radius at Right Angle to Branch Centerline}} = \frac{26.55}{36.19} = 0.73$$

$$\frac{\text{Impeller-Outside Diameter}}{\text{Shroud Width}} = \frac{42.8}{12.5} = 3.42$$

$$\frac{\text{Impeller-Outside Diameter}}{\text{Impeller Eye Diameter}} = \frac{42.8}{18} = 2.38$$

$$\frac{\text{Impeller-Outside Diameter}}{\text{Shell Radius at Tongue}} = \frac{42.8}{26.55} = 1.61$$

Additional physical dimensions and performance characteristics are given in Table 1.

TABLE 1

| | Wear/Performance Comparison | | | | | | | | |
|---|---|---|---|---|---|---|---|---|---|
| | | | | Duty Flow = 12,000 RPM = 585 | | | | Shell Expected Wear Through Time (Months) | |
| | Implr Dia. | Casing Width | BEP Flow | Head ft. $H_2O$ | Power ×1.3 | Water Eff. | Sphere Clearance | 200 um | 300 um |
| COMPARATIVE EX. 1 | 44" | 16" | 23,400 | 243 | 1,350 | 70.0 | 8.5" | 12.7 | 4.2 |
| COMPARATIVE EX. 2 | 44" | 12" | 24,800 | 230 | 1,100 | 77.3 | 7.5" | 4.1 | 1.1 |
| COMPARATIVE EX. 3 | 42.8" (T/D 41") | 13" | 23,100 | 238 | 1,250 | 67-68 | 8-9" | 7.5 | 2.0 |
| EXAMPLE 1 | 46" | 10.5" | 19,500 | 255 | 1,235 | 81-82 | 7.0" | 13.5 | 3.5 |
| EXAMPLE 2 | 46" | 11.5" | 19,500 | 255 | 1,235 | 81-82 | 8.0" | 12.7 | 3.2 |

The shell in each assembly example and comparative example had a thickness of 4 inches in the tongue area, which is the location where wearthrough occurs. As can be seen from Table 1, the shell wearthrough time and/or the water efficiency is greatly improved over that of the pump assemblies in the comparative examples. The pump assemblies of Examples 1 and 2 both have efficiencies of 81 to 82% and have wear properties at least as great as the pumps in the comparative examples. The highest efficiency obtained in the prior art pumps was that of comparative Example 2 (77.3%) yet the shell wearthrough time was considerably less than that of either Example 1 or 2.

The cutwater shape was not a factor in the above examples. Indeed, the particular cutwater shape can be employed in prior art pumps to obtain increased wear resistance in the tongue.

What is claimed is:

1. A shell member for a pump housing of a centrifugal pump for cooperating with the rotatable impeller within said centrifugal pump comprising:

(1) and annular shell provided with a throat having an actual throat area;

(2) a tongue positioned along a peripheral portion of said shell; and (3) an outlet branch having a centerline; wherein the ratio of the radius of the shell at said tongue to the radius of the shell at right angles to a branch centerline is from about 0.8 to 0.9; and (4) said tongue being formed by a cut-water having a shape defined by the equation $y=Ax^B$, wherein x and y are coordinates defining points along the curve defined by the equation $A=F(2^B/w^{(B-1)})$, where B is a number between and including the numbers 2 and 5 and w is the width of the shell and F is a number between and including the numbers 1.0 and 0.5.

2. An impeller for being rotatably disposed within an annular shell of a housing of a centrifugal pump for rotation about the axis of said shell, said impeller including:

(1) an oulet area;

(2) a plurality of vanes;

(3) an inside and outside shroud secured to said vanes and defining a shroud width;

(4) an outside diameter; and (5) an eye having a diameter;

wherein the ratio of said impeller outside diameter to said shroud width being from about 5.0 to about 7.0, the ratio of said impeller outside diameter to said impeller eye diameter being from about 1.5 to about 3.5.

3. The impeller defined claim 2 wherein the ratio of said impeller outside diameter to said shroud width is from about 5.5 to about 6.5, wherein the ratio of said impeller outside diameter of said impeller eye diameter is from about 2.0 to about 3.0, and wherein the ratio of said impeller outside diameter to said shell radius at said tongue is from about 1.6 to about 1.75.

* * * * *